US008573706B2

(12) United States Patent
Parrott et al.

(10) Patent No.: US 8,573,706 B2
(45) Date of Patent: Nov. 5, 2013

(54) CUTTING TOOL WITH NOZZLE FOR SPRAYING WATER ON A CUTTER BIT

(75) Inventors: George Albert Parrott, Wakefield (GB); William P. Sulosky, Davidsville, PA (US)

(73) Assignee: ESCO Windber Inc., Windber, PA (US)

( * ) Notice: Subject to any disclaimer, the term of this patent is extended or adjusted under 35 U.S.C. 154(b) by 0 days.

(21) Appl. No.: 12/934,087

(22) PCT Filed: Dec. 23, 2009

(86) PCT No.: PCT/US2009/069365

§ 371 (c)(1), (2), (4) Date: Sep. 23, 2010

(87) PCT Pub. No.: WO2011/014217

PCT Pub. Date: Feb. 3, 2011

(65) Prior Publication Data

US 2012/0119563 A1 May 17, 2012

Related U.S. Application Data

(60) Provisional application No. 61/229,523, filed on Jul. 29, 2009, provisional application No. 61/235,775, filed on Aug. 21, 2009.

(51) Int. Cl.
*E21C 35/187* (2006.01)

(52) U.S. Cl.
USPC ..... 299/81.3; 299/81.1

(58) Field of Classification Search
USPC ..... 299/81.1, 81.2, 81.3
See application file for complete search history.

(56) References Cited

U.S. PATENT DOCUMENTS

| | | | |
|---|---|---|---|
| 4,333,687 | A | 6/1982 | Barnstorf |
| 4,555,143 | A | 11/1985 | Wrulich et al. |
| 4,678,238 | A | 7/1987 | Emmerich |
| 6,485,104 | B1 | 11/2002 | Keller |
| 7,097,257 | B2 | 8/2006 | Stehney |

FOREIGN PATENT DOCUMENTS

WO WO 2009151949 A1 * 12/2009

* cited by examiner

*Primary Examiner* — Sunil Singh
(74) *Attorney, Agent, or Firm* — Steven P. Schad

(57) ABSTRACT

A cutting tool has a holder block and a sleeve. The sleeve includes a shank and an enlarged flange at an end of the shank. The sleeve shank is received in a hole in the holder block, with the flange against a surface of the holder block and the sleeve shank facing the holder hole wall. A first fillet extending between the holder bore wall and a second fillet extending between the sleeve shank and sleeve flange cooperatively form an annular flow passage for flow of water from the holder into the sleeve.

7 Claims, 2 Drawing Sheets

CUTTING TOOL WITH NOZZLE FOR SPRAYING WATER ON A CUTTER BIT

FIELD OF THE INVENTION

The invention relates to cutting tools used with drum-type cutters and the like, and in particular to a cutting tool with a nozzle for spraying water on a cutter bit.

BACKGROUND OF THE INVENTION

Stehney U.S. Pat. No. 7,097,257 discloses a cutting tool that includes a holder block and a sleeve for holding the cutter bit. The sleeve has an enlarged flange and a shank extending from the flange. The flange is received in a hole or bore in the holder block. Typically an interference fit between the flange and the holder block resists rotation of the sleeve in the holding block.

The sleeve flange has a rearwardly facing shoulder that faces the holder block when the sleeve shank is received in the holder block. A first, inner annular groove machined at the interface between the flange shoulder and the holder block flows water to a nozzle carried in the flange. A second, outer annular groove machined at the interface carries an O-ring that forms a seal. The nozzle sprays water towards the cutting bit.

The cutting tool disclosed in the '257 patent performs well. But there is an ongoing demand to reduce the cost of cutting tools.

BRIEF SUMMARY OF THE INVENTION

The invention is an improved cutting tool that requires machining only one annular groove at the interface between the flange shoulder and the holder block, thereby reducing cost.

A cutting tool in accordance with the present invention includes a holder block and a sleeve. The holder block includes a first flow passage, a bore wall defining a first hole in the block, an outer periphery wall, and a first fillet joining the bore wall and the outer periphery wall.

The sleeve includes a shank, an enlarged flange at an end of the shank, a second fillet joining the shank and flange, a nozzle bore in the flange, a second hole for receiving a cutter bit, and a second flow passage fluidly connected to the spray nozzle bore.

The sleeve shank is received in the first hole of the holder block. The sleeve shank faces the holder bore wall and the sleeve flange overlays the holder periphery wall.

The first and second fillets cooperatively define an annular flow passage between them, with each of the first and second flow passages having an opening facing the annular flow passage to flow water from the first flow passage, through the annular flow passage, and to the second flow passage.

The shank and holder fillets define an annular flow passage between them without the need to machine either the shank or the holder to form the flow passage. This simplifies manufacture of the cutting tool and reduces cost.

In a preferred embodiment of the invention an O-ring is trapped in the annular flow passage and compressed between the sleeve and holder block. The trapped O-ring resists water in the annular flow passage from leaking out and collecting between the sleeve shank and the holder bore wall, thereby minimizing rust formation between the sleeve shank and the holder block that could later resist disassembly of the sleeve and holder block. Placing the O-ring in the flow passage eliminates the need for an annular groove in the sleeve shank to hold the O-ring, further reducing cost.

Other objects and features of the invention will become apparent as the description proceeds, especially when taken in conjunction with the accompanying two drawing sheets illustrating two embodiments of the invention.

DESCRIPTION OF THE PREFERRED EMBODIMENTS

Figure 2:
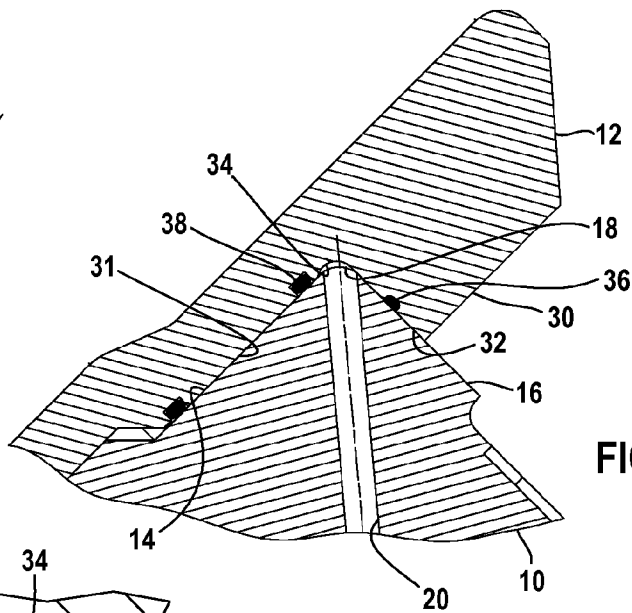
FIG. 2 is an enlarged view of a portion of FIG. 1.
Figure 3:
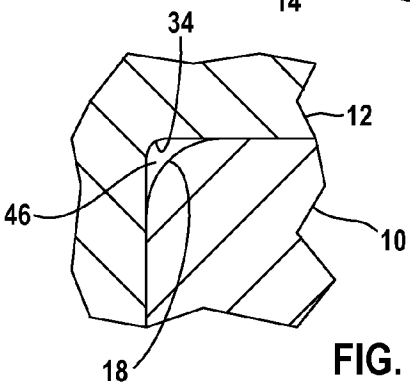
FIG. 3 is an enlarged view of a portion of FIG. 2.
Figure 1:
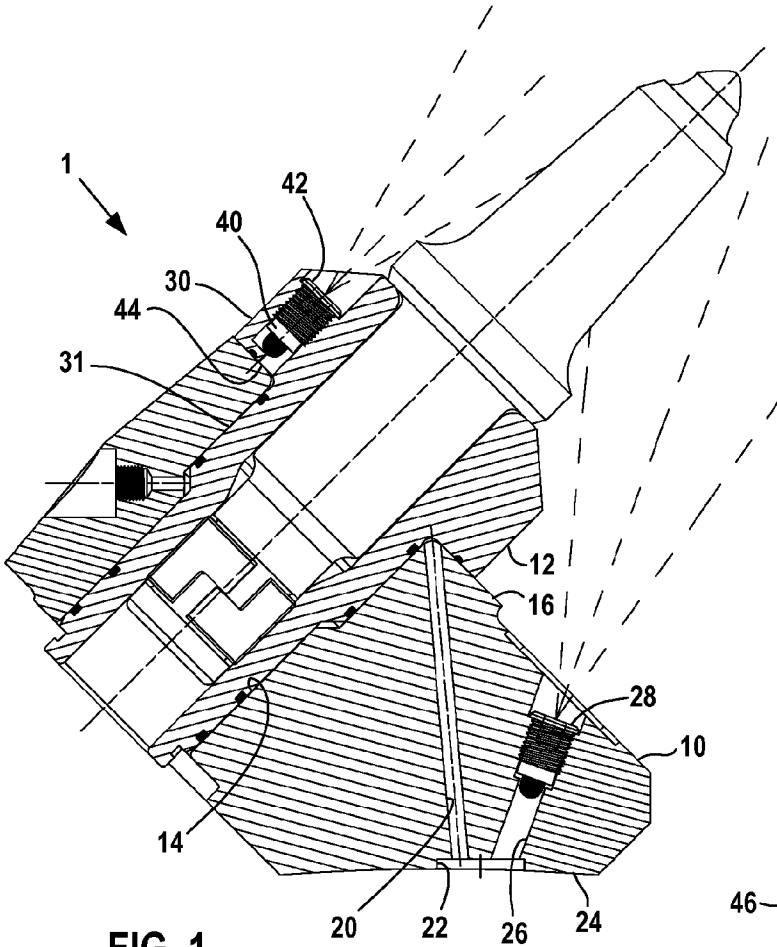
FIG. 1 is a vertical sectional view of a first embodiment cutting tool in accordance with the present invention, the cutting tool shown holding a cutting bit that forms no part of the invention.

FIGS. 1, 2, and 3 illustrate a first embodiment improved cutting tool 1 in accordance with the invention. The improved tool includes a holder block 10 and a sleeve 12 that is received in a hole of the holder block. The block 10 has an outer flat periphery wall or surface 16 surrounding the hole defined by a hole wall 14. A relatively larger fillet 18 joins the hole wall 14 and the periphery wall 16. The fillet 18 has a constant, convex fillet radius that extends between the hole wall 14 and the peripheral wall 16. An internal water channel 20 extends through the block 10 from the radius to a counterbore 22 formed in a base surface 24 of the block. The counterbore 22 is also connected to another internal water channel 26 that holds a spray nozzle 28 spaced away from the surface 16.

The sleeve 12 has an enlarged flange 30 and a shank 31 extending from the flange. The flange 30 has a generally flat rear shoulder or surface 32 that butts against and overlays the holder peripheral wall 16 and locates the sleeve 12 against the holder block 10 when the cutting tool is assembled. A relatively smaller fillet 34 joins the flange 30 and the shank 31. The fillet 34 has a constant, concave radius that extends between the flange surface 34 and the shank 31. An annular sealing groove 36 is formed in the sleeve surface 32 radially outwardly of the radius 34. An annular sealing groove 38 is formed in the shank 31 and spaced from the radius 34. An internal water channel 40 extends through the flange 30 and carries a spray nozzle 42. The channel 40 has an inlet opening 44 opening on the flank surface 32 and overlapping the radius 34.

When the cutting tool is assembled, the relatively larger holder block fillet 18 and the relatively smaller sleeve fillet 34 cooperatively define an annular chamber 46 between the block and the sleeve (see FIG. 3) without the need to machine an annular groove at the interface between the block and the sleeve. The volume of the chamber 46 is a function of the radii 18, 34 and the diameter of the shank 31.

Chamber 46 receives water from block flow channel 20 and flows water to the sleeve flow channel 40. O-ring seals in the sealing grooves 36, 38 resist leakage from the chamber 46. The O-ring in the sealing groove 38 is also used to seal around the sleeve shank 31 when water pressure is applied to the sleeve for disassembly of the cutting tool. Sealing between the sleeve shank 31 and the bore wall 14 to enable hydraulic pressure to urge the sleeve out of the holder block is conventional and so will not be described in further detail.

Figures 4, 5:
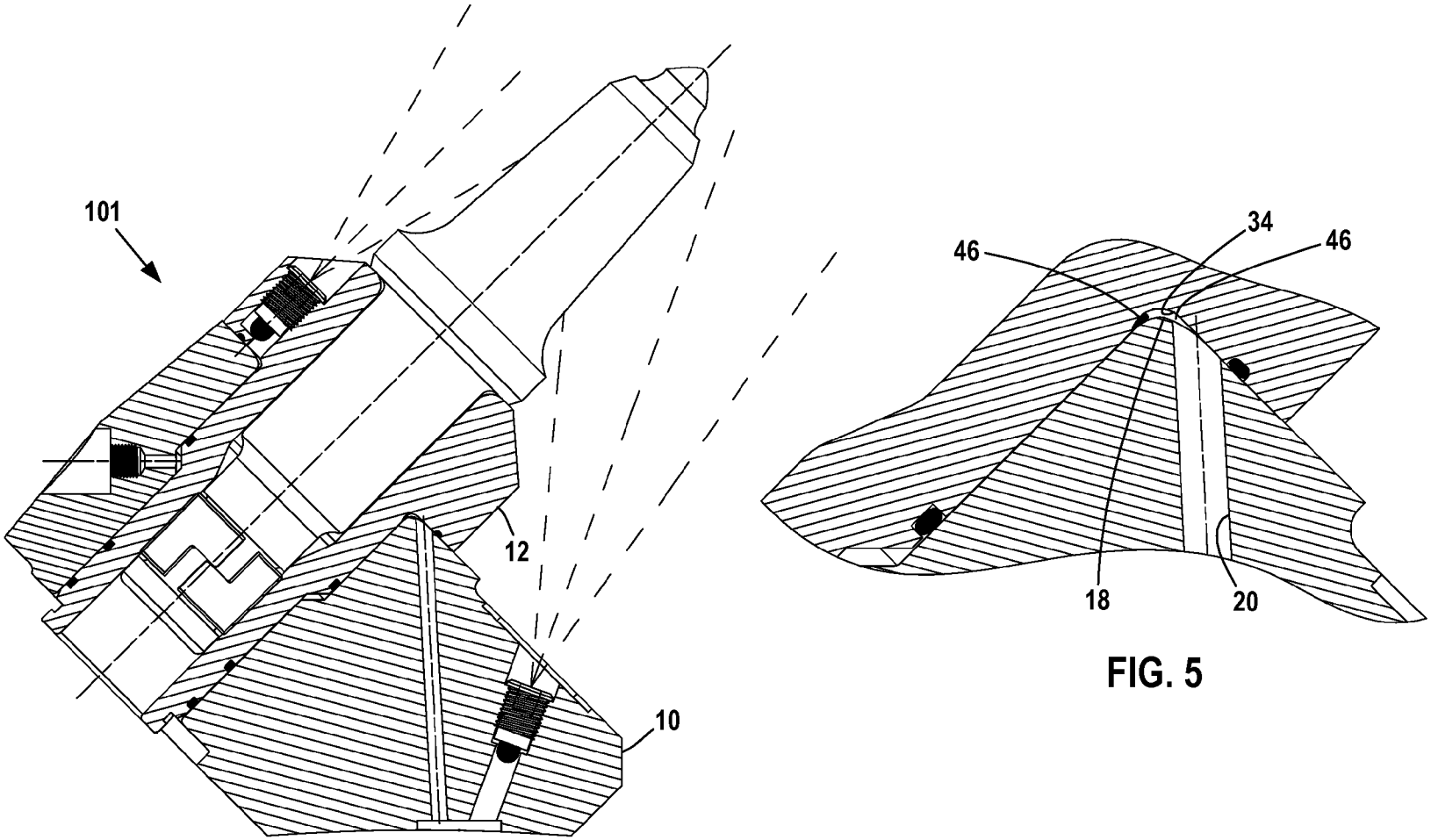
FIG. 4 is a view similar to FIG. 1 of a second embodiment cutting tool in accordance with the present invention.
FIG. 5 is an enlarged view of a portion of FIG. 4.

FIGS. 4 and 5 illustrate a second embodiment improved cutting tool 101 in accordance with the invention. The second embodiment cutting tool is similar to the first embodiment cutting tool and so only differences between them will be discussed. The same reference numerals as used with the first embodiment cutting tool will identify the corresponding features of the second embodiment cutting tool.

In the second embodiment cutting tool each of the holder block fillet 18 and the sleeve fillet 34 do not have a constant dimension, that is, the fillet radius of each fillet 18 or fillet 34 do not have a constant radius of curvature. Instead, the value of the fillet radius differs along the circumferential length of the fillet 18 or 34. In the illustrated embodiment each radius 18 and radius 34 consists of three portions, each portion having a different radius of curvature from the other two portions. This enables an annular chamber 46 defined by the fillets 18 and 34 to have a larger volume than the first embodiment chamber 46.

The illustrated radii of fillets 18 and 34 are curved and arcuate along the entire arcuate length of each fillet, that is, no portion of the fillet cross-section is flat or planar. In other embodiments the cross-sections of the fillets 18 and 34 can include essentially flat portions, that is, portions having an essentially infinite radius of curvature. For example, the portion of the fillet 34 adjacent the flat flange surface 32 can have an essentially infinite radius of curvature, thereby defining an inclined, conical fillet portion extending away from the surface 32.

In the second embodiment the O-ring groove 38 is eliminated and instead an O-ring 46 is captured between the sleeve and the holder block fillets 18, 34 adjacent the shank 31 as best seen in FIG. 5. The discharge end of the block flow channel 20 is moved away from the sleeve shank 31. These features help minimize rust formation between the sleeve shank 31 and the holder block bore 14 that could resist disassembly of the sleeve and holder block.

While we have illustrated and described preferred embodiments of our invention, we therefore do not wish to be limited to the precise details set forth, but desire to avail ourselves of such changes and alterations as fall within the purview of the following claims.

The invention claimed is:

1. An assembly comprising:

a holder block and a sleeve;

the holder block comprising a first flow passage, an outer periphery wall, a bore wall defining a first hole in the block wherein the first hole opens in the outer periphery wall, and a first fillet joining the bore wall and the outer periphery wall;

the sleeve comprising a shank, a flange at an end of the shank, the flange having a shoulder, a second fillet joining the shank and flange, a nozzle bore in the flange, a second hole for receiving a cutter bit, and a second flow passage fluidly connected to the nozzle bore;

the sleeve shank is received in the first hole of the holder block so that the sleeve shank faces the holder bore wall, the sleeve flange shoulder is entirely outside of the holder block, and the shoulder butts against and overlays the outer periphery wall;

the first and second fillets cooperatively defining an annular flow passage there between, each of the first and second flow passages having an opening facing the annular flow passage to flow water from the first flow passage and through the annular flow passage to the second flow passage.

2. The assembly of claim 1 wherein the first and second fillets each has a respective substantially constant radius of curvature.

3. The assembly of claim 2 wherein the first fillet radius is greater than the second fillet radius.

4. The assembly of claim 1. including an O-ring in the annular flow passage.

5. The assembly of claim 4 wherein the O-ring is adjacent the sleeve shank to resist leakage of water from the annular flow passage to between the sleeve shank and holder bore wall.

6. An assembly comprising:

a holder block and a sleeve;

the holder block comprising a first flow passage, a bore wall defining a first hole in the block, an outer periphery wall, and a first fillet joining the bore wall and the outer periphery wall;

the sleeve comprising a shank, a flange at an end of the shank, a second fillet joining the shank and flange, a nozzle bore in the flange, a second hole for receiving a cutter bit, and a second flow passage fluidly connected to the nozzle bore;

the sleeve shank received in the first hole of the holder block, the sleeve shank facing the holder bore wall, the sleeve flange overlaying the holder periphery wall;

the first and second fillets cooperatively defining an annular flow passage there between, each of the first and second flow passages having an opening facing the annular flow passage to flow water from the first flow passage and through the annular flow passage to the second flow passage, wherein at least one of the first and second fillets has a radius of curvature that varies along the at least one fillet.

7. An assembly comprising:

a holder block and a sleeve;

the holder block comprising a first flow passage, a bore wall defining a first hole in the block, an outer periphery wall, and a first fillet joining the bore wall and the outer periphery wall;

the sleeve comprising a shank, a flange at an end of the shank, a second fillet joining the shank and flange, a nozzle bore in the flange, a second hole for receiving a cutter bit, and a second flow passage fluidly connected to the nozzle bore;

the sleeve shank received in the first hole of the holder block, the sleeve shank facing the holder bore wall, the sleeve flange overlaying the holder periphery wall;

the first and second fillets cooperatively defining an annular flow passage there between, each of the first and second flow passages having an opening facing the annular flow passage to flow water from the first flow passage and through the annular flow passage to the second flow passage, wherein the annular flow passage includes a radially inner portion adjacent the sleeve shank and a radially outer portion away from the sleeve shank, the first flow passage opening offset with respect to the annular flow passage and opens into the radially outer portion of the annular flow passage without opening into the radially inner portion of the annular flow passage.

* * * * *